US011039639B2

(12) United States Patent
Fujisawa et al.

(10) Patent No.: US 11,039,639 B2
(45) **Date of Patent: *Jun. 22, 2021**

(54) PRODUCING METHOD OF TOBACCO RAW MATERIAL

(71) Applicant: JAPAN TOBACCO INC., Tokyo (JP)

(72) Inventors: Yoshinori Fujisawa, Tokyo (JP); Takeshi Akiyama, Tokyo (JP); Shinya Osuga, Tokyo (JP); Manabu Takeuchi, Tokyo (JP); Manabu Yamada, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 249 days.

This patent is subject to a terminal disclaimer.

(21) Appl. No.: 15/247,166

(22) Filed: Aug. 25, 2016

(65) Prior Publication Data

US 2016/0360781 A1 Dec. 15, 2016

Related U.S. Application Data

(63) Continuation of application No. PCT/JP2014/078410, filed on Oct. 24, 2014.

(30) Foreign Application Priority Data

Feb. 26, 2014 (JP) ..... JP2014-035429
Feb. 26, 2014 (JP) ..... JP2014-035438

(51) Int. Cl.
*A24B 15/24* (2006.01)
*A24B 15/167* (2020.01)
(Continued)

(52) U.S. Cl.
CPC ..... *A24B 15/24* (2013.01); *A24B 15/167* (2016.11); *A24B 15/243* (2013.01); *A24B 15/26* (2013.01); *A24B 15/28* (2013.01); *A24B 15/32* (2013.01)

(58) Field of Classification Search
None
See application file for complete search history.

(56) References Cited

U.S. PATENT DOCUMENTS 1,538,265 A 5/1925 Arnold
2,565,052 A * 8/1951 Sowa ..... A24B 15/24 131/275

(Continued)

FOREIGN PATENT DOCUMENTS

CA 2316249 A1 1/2000
CN 1050540 A 4/1991

(Continued)

OTHER PUBLICATIONS

Notification of Examination Result dated Jan. 9, 2017, in Taiwan Patent Application No. 104134843, with English translation.

(Continued)

*Primary Examiner* — Phu H Nguyen
(74) *Attorney, Agent, or Firm* — Birch, Stewart, Kolasch & Birch, LLP

(57) ABSTRACT

A producing method of a tobacco raw material comprises: a step A1 for heating a tobacco raw material in a closed space which is treated with alkali and for taking a flavor constituent released in the gas phase from the tobacco raw material to an outside of the closed space; a step B1 for allowing a first solvent to capture the flavor constituent by bringing the flavor constituent released in the gas phase in the step A1 into contact with the first solvent which is a liquid substance at normal temperature on the outside of the closed space; and a step C1 for adding the first solvent capturing the flavor constituent in the step B1 to the tobacco raw material in the closed space after the step B1.

20 Claims, 8 Drawing Sheets

(51) Int. Cl.

| | |
|---|---|
| ***A24B 15/26*** | (2006.01) |
| ***A24B 15/28*** | (2006.01) |
| ***A24B 15/32*** | (2006.01) |

(56) References Cited

U.S. PATENT DOCUMENTS

| | | | | |
|---|---|---|---|---|
| 2,822,306 | A | 2/1958 | Thienemann et al. | |
| 4,215,706 | A | 8/1980 | Larson et al. | |
| 4,244,381 | A | 1/1981 | Lendvay | |
| 4,941,484 | A | 7/1990 | Clapp et al. | |
| 5,005,593 | A | 4/1991 | Fagg | |
| 5,016,654 | A | 5/1991 | Bernasek et al. | |
| 5,018,540 | A * | 5/1991 | Grubbs | A24B 15/24 131/297 |
| 5,038,802 | A | 8/1991 | White et al. | |
| 5,065,775 | A | 11/1991 | Fagg | |
| 5,121,757 | A | 6/1992 | White et al. | |
| 5,235,992 | A | 8/1993 | Sensabaugh, Jr. | |
| 5,311,886 | A | 5/1994 | De Grandpre et al. | |
| 5,435,325 | A | 7/1995 | Clapp et al. | |
| 5,445,169 | A | 8/1995 | Brinkley et al. | |
| 5,533,530 | A | 7/1996 | Young et al. | |
| 5,715,844 | A | 2/1998 | Young et al. | |
| 6,109,272 | A | 8/2000 | Saito et al. | |
| 2007/0023058 | A1 * | 2/2007 | Howell | A24B 15/243 131/298 |
| 2007/0137665 | A1 | 6/2007 | Torikai et al. | |
| 2007/0193596 | A1 | 8/2007 | Mori et al. | |
| 2011/0083683 | A1 | 4/2011 | Krauss | |
| 2011/0155152 | A1 | 6/2011 | Harris et al. | |
| 2012/0006345 | A1 | 1/2012 | Yajima et al. | |

FOREIGN PATENT DOCUMENTS

| | | | |
|---|---|---|---|
| CN | 102401816 | A * | 4/2012 |
| CN | 103589514 | A | 2/2014 |
| EP | 1782702 | A1 | 5/2007 |
| EP | 1 915 064 | A2 | 4/2008 |
| JP | 1-235571 | A | 9/1989 |
| JP | 2-49572 | A | 2/1990 |
| JP | 2-238873 | A | 9/1990 |
| JP | 3-10667 | A | 1/1991 |
| JP | 5-7485 | A | 1/1993 |
| JP | 8-98672 | A | 4/1996 |
| JP | 8-504598 | A | 5/1996 |
| JP | 9-9947 | A | 1/1997 |
| JP | 2872408 | B2 | 3/1999 |
| JP | 11-113552 | A | 4/1999 |
| JP | 2002-520005 | A | 7/2002 |
| JP | 2003-516723 | A | 5/2003 |
| JP | 2006-180715 | A | 7/2006 |
| JP | 2009-502160 | A | 1/2009 |
| JP | 2009-261314 | A | 11/2009 |
| JP | 2011-522558 | A | 8/2011 |
| JP | 2013-507104 | A | 3/2013 |
| WO | WO 94/24892 | A1 | 11/1994 |
| WO | WO 01/28367 | A1 | 4/2001 |
| WO | WO 2005/122803 | A1 | 12/2005 |
| WO | WO 2006/022198 | A1 | 3/2006 |
| WO | WO 2006/046517 | A1 | 5/2006 |
| WO | WO 2007/052159 | A2 | 5/2007 |
| WO | WO 2007/053097 | A1 | 5/2007 |
| WO | WO 2007/052159 | A3 | 6/2007 |
| WO | WO 2009/150444 | A1 | 12/2009 |
| WO | WO 2010/110227 | A1 | 9/2010 |
| WO | WO 2013/146952 | A1 | 10/2013 |

OTHER PUBLICATIONS

Notification of Reason(s) for Refusal dated Feb. 7, 2017, in Japanese Patent Application No. 2016-504994, with English translation.
Extended European Search Report dated Aug. 25, 2017, in European Patent Application No. 15755597.0.
Extended European Search Report dated Oct. 4, 2017, in European Patent Application No. 15755206.8.
Extended European Search Report dated Sep. 14, 2017, in European Patent Application No. 14883799.0.
Notification of Reasons for Refusal dated Sep. 12, 2017, in Japanese Patent Application No. 2016-555187, with English translation.
Official Action dated Sep. 29, 2017, in Russian Patent Application No. 2016137908, with English translation.
International Search Report for PCT/JP2014/078410 (PCT/ISA/210) dated Feb. 3, 2015.
Written Opinion of the International Searching Authority for PCT/JP2014/078410 (PCT/ISA/237) dated Feb. 3, 2015.
First Office Action dated Jun. 9, 2017, in Chinese Patent Application No. 201480076381.X, with English translation.
Database WPI, Week 199211, Thomson Scientific, London, GB; AN 1992-080599, XP002781325 & CN 1 050 540 A (Feng Shixing) Apr. 10, 1991, abstract.
Database WPI, Week 201427, Thomson Scientific, London, GB; AN 2014-G75248 XP002781324 & CN 103 589 514 A (Shanghai Tocacco Group Co., Ltd.), Feb. 19, 2014, abstract.
Extended European Search Report dated Jun. 5, 2018, in European Patent Application No. 15852051.0.
U.S. Office Action for copending U.S. Appl. No. 15/246,753, dated Feb. 7, 2019.
Canadian Office Action for corresponding Canadian Application No. 2,940,612, dated Oct. 13, 2017.
Canadian Office Action for corresponding Canadian Application No. 2,940,680, dated Oct. 12, 2017.
Canadian Office Action for corresponding Canadian Application No. 2,940,690, dated Oct. 13, 2017.
Chinese Office Action for corresponding Chinese Application No. 201580010569.9, dated Jun. 2, 2017, with English translation.
Chinese Office Action for corresponding Chinese Application No. 201580010590.9, dated Jun. 2, 2017, with English translation.
International Search Report for International Application No. PCT/JP2015/055208, dated May 19, 2015.
International Search Report for International Application No. PCT/JP2015/055209, dated May 19, 2015.
International Search Report for International Application No. PCT/JP2015/079053, dated Dec. 28, 2015.
Korean Office Action for corresponding Korean Application No. 10-2016-7022737, dated Oct. 30, 2017, with English translation.
Korean Office Action for corresponding Korean Application No. 10-2016-7022739, dated Oct. 30, 2017, with English translation.
U.S. Office Action for U.S. Appl. No. 15/246,753, dated Jun. 28, 2018.
U.S. Office Action for U.S. Appl. No. 15/493,400, dated Feb. 25, 2019.
U.S. Office Action for U.S. Appl. No. 15/493,400, dated Jul. 12, 2018.
U.S. Office Action for U.S. Appl. No. 15/493,400, dated May 22, 2019.
Second Office Action dated Jan. 12, 2018, in Chinese Patent Application No. 201480076381.X, with English translation.
U.S. Office Action, dated Sep. 27, 2018, in Copending U.S. Appl. No. 15/247,208.
U.S. Office Action for U.S. Appl. No. 15/246,753, dated Oct. 21, 2019.
U.S. Appl. No. 15/493,400, filed Apr. 21, 2017.

* cited by examiner

FIG. 5

| SAMPLE | TYPE | Nic. AMOUNT [wt%-DB] | $NH_4^+$ AMOUNT [ug/g-DB] |
|---|---|---|---|
| SAMPLE A | BURLEY TYPE | 4.9 | 4545 |
| SAMPLE B | FLUE CURED TYPE | 4.2 | 568 |
| SAMPLE C | FLUE CURED TYPE | 1.8 | 543 |

PRODUCING METHOD OF TOBACCO RAW MATERIAL

CROSS REFERENCE TO RELATED APPLICATIONS

This application is a Continuation of PCT International Application No. PCT/JP2014/078410, filed on Oct. 24, 2014, which claims priority under 35 U.S.C. 119(a) to Patent Application Nos. JP 2014-035429, filed in Japan on Feb. 26, 2014, and JP 2014-035438, filed in Japan on Feb. 26, 2014, all of which are hereby expressly incorporated by reference into the present application.

TECHNICAL FIELD

The present invention relates to a producing method of a tobacco raw material containing a flavor constituent.

BACKGROUND ART

As a technique to allow a flavor source to contain a flavor constituent (e.g. alkaloid including a nicotine component), a technique utilizing a tobacco raw material itself as a flavor source, and a technique in which a flavor constituent is extracted from a tobacco raw material and supported on a base material for a flavor source have been conventionally known.

In the above-described techniques, there is a possibility that impurity components contained in a tobacco raw material have a bad effect on a smoking flavor and the like, and thus it is desired that only the impurity components be selectively separated/reduced from the tobacco raw material. In the existing techniques, however, a complicated process is required, and thus there has been a problem in that simple and low-cost separation and reduction are difficult.

CITATION LIST

Patent Literature

Patent Literature 1: U.S. Pat. No. 4,215,706
Patent Literature 2: JP 2009-502160 A
Patent Literature 3: U.S. Pat. No. 5,235,992

SUMMARY

A first feature is summarized as a producing method of a tobacco raw material containing a flavor constituent, comprising: a step A1 for heating a tobacco raw material in a closed space which is treated with alkali and for taking a flavor constituent released in the gas phase from the tobacco raw material to an outside of the closed space; a step B1 for allowing a first solvent to capture the flavor constituent by bringing the flavor constituent released in the gas phase in the step A1 into contact with the first solvent which is a liquid substance at normal temperature on the outside of the closed space; and after the step B1, a step C1 for adding the first solvent capturing the flavor constituent in the step B1 to the tobacco raw material from which the flavor constituent is released to the closed space in the step A1 in the closed space.

A second feature is summarized as a producing method of a tobacco raw material containing a flavor constituent, comprising: a step A2 for heating a tobacco raw material in a closed space which is treated with alkali and for taking a flavor constituent released in the gas phase from the tobacco raw material to an outside of the closed space; a step B2 for allowing a first solvent to capture the flavor constituent by bringing the flavor constituent released in the gas phase in the step A2 into contact with the first solvent which is a liquid substance at normal temperature on the outside of the closed space; and a step C2 for supplying a second solvent to the tobacco raw material in the closed space after the step A2 and for taking a normal component which is released as the liquid phase from the tobacco raw material to the second solvent, together with the second solvent to the outside of the closed space; and after the step B2 and the step C2, the step D2 for adding the first solvent capturing the flavor constituent in the step B2 to the tobacco raw material from which the flavor constituent is released in the closed space in the step A2 in the closed space.

A third feature is summarized as the production method according to the second feature, wherein the step C2 is repeated at least twice or more before the step D2.

A fourth feature is summarized as the production method according to the third feature, wherein when n is an integer of 1 or more, a solvent A is used as the second solvent in the n-th step C2, and a solvent B different from the solvent A is used as the second solvent in the n+1-th step C2.

A fifth feature is summarized as the production method according to any one of the first feature to the fourth feature, wherein the step A1 or the step A2 comprises a step in which the tobacco source is subjected to a water addition treatment.

A sixth feature is summarized as the production method according to the fifth feature, wherein in the step A1 or the step A2, an amount of water in the tobacco source before heating the tobacco source becomes 30 wt % or more by the water addition treatment.

A seventh feature is summarized as the production method according to any one of the second feature to the fourth feature, wherein the step A2 comprises a step for adding a non-aqueous solvent to the tobacco raw material.

A eighth feature is summarized as the production method according to the seventh feature, wherein the amount of the non-aqueous solvent is 10 wt % or more with respect to the tobacco raw material.

A ninth feature is summarized as the production method according to the seventh feature or eighth feature, the step A2 comprises a step for adding the non-aqueous solvent and water to the tobacco raw material.

A tenth feature is summarized as the production method according to any one of the first feature to the ninth feature, wherein the step B1 or the step B2 is carried out until any time from when a first condition is satisfied to when a second condition is satisfied, the total amount of saccharides contained in the tobacco raw material is 10.0 wt % or less in the case where the gross weight of the tobacco raw material in the dry state is 100 wt %, in a case where a stable zone in which variations in pH of the collection solution are within a predetermined range exists in the time axis elapsing from the beginning of the step A1 or the step A2 after the pH of a collection solution containing the first solvent and the release component decreases by 0.2 or more from the maximum value, the first condition is a condition that a time elapsing from the beginning of the step A1 or the step A2 reaches the start time of the stable zone, and the second condition is a condition that the remaining amount of nicotine component which is an index of the flavor constituent contained in the tobacco raw material decreases until reaching 0.3 wt % in the case where the weight of the tobacco raw material in the dry state is 100 wt %.

An eleventh feature is summarized as the production method according to the tenth feature, wherein the second condition is a condition that the remaining amount of the nicotine component contained in the tobacco raw material decreases until reaching 0.4 wt %, in the case where the weight of the tobacco raw material in the dry state is 100 wt %.

A twelfth feature is summarized as the production method according to the tenth feature, wherein the second condition is a condition that the remaining amount of the nicotine component contained in the tobacco raw material decreases until reaching 0.6 wt %, in the case where the weight of the tobacco raw material in the dry state is 100 wt %.

A thirteenth feature is summarized as the production method according to any one of the tenth feature to the twelfth feature, wherein the tobacco raw material is a burley type tobacco raw material.

A fourteenth feature is summarized as the production method according to any one of the first feature to the ninth feature, the step B1 or the step B2 is carried out at any time from when a first condition is satisfied to when a second condition is satisfied, the first condition is a condition that a remaining amount of nicotine component which is an index of the flavor constituent contained in the tobacco raw material decreases until reaching 1.7 wt % in the case where the weight of the tobacco raw material in the dry state is 100 wt % and the second condition is a condition that the remaining amount of the nicotine component contained in the tobacco raw material decreases until reaching 0.3 wt % in the case where the weight of the tobacco raw material in the dry state is 100 wt %.

A fifteenth feature is summarized as the production method according to the fourteenth feature, wherein the second condition is a condition that the remaining amount of the nicotine component contained in the tobacco raw material decreases until reaching 0.4 wt %, in the case where the weight of the tobacco raw material in the dry state is 100 wt %.

A sixteenth feature is summarized as the production method according to the fourteenth feature, wherein the second condition is a condition that the remaining amount of the nicotine component contained in the tobacco raw material decreases until reaching 0.6 wt %, in the case where the weight of the tobacco raw material in the dry state is 100 wt %.

A seventeenth feature is summarized as the production method according to any one of the fourteenth feature to the sixteenth, wherein a temperature of the first solvent is 10° C. or more and 40° C. or less.

It is preferred that the volume of the closed space recited in the first feature or the second feature not be extremely different from the volume of a tobacco raw material from the viewpoint of reducing the loss of a tobacco raw material by reducing the inner surface of the closed space. It is also preferred that the volume of the closed space recited in the second feature not be extremely different from the volume of a tobacco raw material from the viewpoint of efficient washing. It is preferred that the shape of the closed space recited in the first feature or the second feature not contain an extremely long part and the like from the viewpoint of reducing the loss of a tobacco raw material by reducing the inner surface of the closed space. It is also preferred that the shape of the closed space recited in the second feature not contain an extremely long part and the like from the viewpoint of efficient washing. It is preferred that the volume of the closed space be for example 3 times or more and 50 times or less the volume of a tobacco raw material. About the shape of the closed space, it is also preferred that when the lengths of the longest parts in the X direction, the Y direction and the Z direction which are directions intersecting each other at 90 degrees in the closed space are considered as X, Y and Z respectively and two values between X, Y and Z which differ most are used as L and S (S is a value smaller than L), L be 10 times or less higher than S. As long as the volume and shape of the closed space are as described above, the loss of a tobacco raw material can be reduced, and further a tobacco raw material (residue) can be sufficiently washed in Step C2 recited in the second feature using a moderate amount of solvent while moderately stirring the tobacco raw material.

It should be noted that when the inner surface of the closed space is reduced or an extremely long part and the like are not contained in the shape of the closed space, the contact area of a tobacco raw material with the inner surface of the closed space decreases, and a tobacco raw material adhering to the inner surface of the closed space also decreases, thereby reducing the loss of the tobacco raw material.

It should be noted that all above-described wt % is percent by weight in the dry state.

BRIEF DESCRIPTION OF DRAWINGS

FIG. 5 is a diagram illustrating the first experiment.

DESCRIPTION OF EMBODIMENTS

Next, an embodiment will be described. Note that, the same or similar portions are denoted with the same or similar reference signs in the descriptions of the drawings below. Note that, the drawings are schematic and a ratio of each size is different from a real one.

Therefore, specific sizes and the like should be judged in consideration of the following descriptions. Needless to say, portions of which relationship and ratios of mutual sizes are different between the mutual drawings, are included.

First Embodiment (Production Device)

Figure 1:
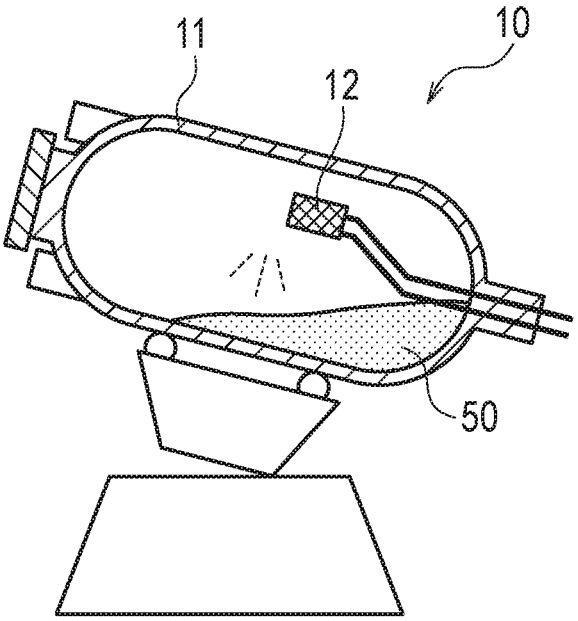
FIG. 1 is a diagram illustrating an example of the extraction device in the first embodiment.
Figure 2:
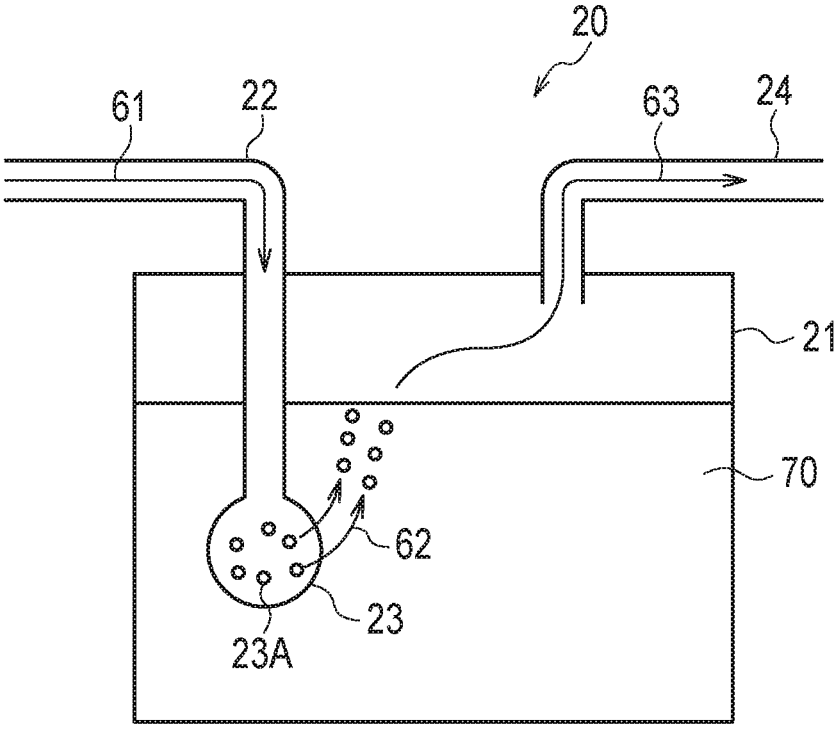
FIG. 2 is a diagram illustrating an example of the extraction device in the first embodiment.

The production device according to the first embodiment will be described below. FIG. 1 and FIG. 2 are diagrams showing an example of the production device according to the first embodiment.

First, an example of a treatment device 10 will be described with reference to FIG. 1. The treatment device 10 has a container 11 and a spray 12.

A tobacco raw material 50 is put in the container 11. The container 11 is constituted of for example members with heat resistance and pressure resistance (e.g. SUS; Steel Used Stainless). It is preferred that the container 11 constitute a closed space. The "closed space" is a space to prevent the contamination of the space by solid foreign substances in normal handling (e.g. treatment action, transportation, storage, etc.) and inhibit the movement of a flavor constituent (e.g. a nicotine component) contained in the tobacco raw material 50 to the outside of the space. Because of this, a tobacco raw material is maintained in a sanitary condition and it is not required to transfer the tobacco raw material, and therefore the loss of the tobacco raw material decreases. It should be noted however that the treatments for intentionally taking a predetermined component to the outside of the space like for example Step S30 (capture treatment) and Step S60 (washing) described below are not contrary to the definition of the above-described "closed space".

It should be noted that a nicotine component is an example of a flavor constituent contributing to a tobacco smoking flavor and is used as an index of the flavor constituent in the embodiment.

The spray 12 provides an alkaline substance for the tobacco raw material 50. It is preferred that a basic substance such as an aqueous solution of potassium carbonate, for example, be used as an alkaline substance.

It is preferred that the spray 12 provide an alkaline substance for the tobacco raw material 50 until the pH of the tobacco raw material 50 becomes 8.0 or more. It is further preferred that the spray 12 provide an alkaline substance for the tobacco raw material 50 until the pH of the tobacco raw material 50 becomes in a range from 8.9 to 9.7. In order to efficiently release a flavor constituent in the gas phase from the tobacco raw material 50, the amount of water in the tobacco raw material 50 after spraying of an alkaline substance is preferably 10 wt % and further preferably 30 wt % or more. The upper limit of the amount of water in the tobacco raw material 50 is not particularly limited, and is for example preferably 50 wt % or less in order to efficiently heat the tobacco raw material 50.

It is preferred that the initial amount of flavor constituent (herein, a nicotine component) contained in the tobacco raw material 50 be 2.0 wt % or more in the case where the gross weight of the tobacco raw material 50 in the dry state is 100 wt %. It is further preferred that the initial amount of flavor constituent (herein, a nicotine component) contained be 4.0 wt % or more.

As the tobacco raw material 50, for example, *Nicotiana* raw materials such as *Nicotiana. tabacum* and *Nicotiana. rustica* can be used. As *Nicotiana tabacum*, for example, a variety such as Burley type or flue cured type can be used. As the tobacco raw material 50, a tobacco raw material of a type other than Burley type and flue cured type may be also used.

The tobacco raw material 50 may be constituted of a cut or powder tobacco raw material. In such case, the diameter of a cut or powder substance is preferably 0.5 mm to 1.18 mm.

Second, an example of a collection device 20 will be described with reference to FIG. 2. The collection device 20 has a container 21, a pipe 22, a release section 23 and a pipe 24.

A capture solvent 70 (i.e. a first solvent) is put in the container 21. The container 21 is constituted of for example a glass. It is preferred that the container 21 constitute of an airtight space to a degree in which the movement of air to the outside of the space can be inhibited.

The temperature of the collection solvent 70 is for example normal temperature. The lower limit of normal temperature is for example a temperature at which the collection solvent 70 is not solidified, preferably 10° C. The upper limit of normal temperature is for example 40° C. or less. By setting the temperature of the collection solvent 70 to 10° C. or more and 40° C. or less, as the vaporization of a flavor constituent from a collection solution is inhibited, volatile impurity components such as ammonium ion and pyridine can be efficiently removed from the collection solution. As the collection solvent 70, for example, glycerin, water or ethanol can be used. In order to prevent the revaporization of a flavor constituent captured by the collection solvent 70, any acid such as malic acid or citric acid may be added to the collection solvent 70. In order to raise capture efficiency for a flavor constituent, a solvent such as an aqueous solution of citric acid may be added to the collection solvent 70. That is, the collection solvent 70 may be constituted of several types of solvents. In order to raise capture efficiency for a flavor constituent, the initial pH of the collection solvent 70 is preferably lower than the pH of the tobacco raw material 50 after an alkali treatment.

The pipe 22 takes a release component 61, which is released in the gas phase from the tobacco raw material 50 by heating the tobacco raw material 50, to the capture solvent 70. The release component 61 contains at least a nicotine component which is an index of a flavor constituent. Since the tobacco raw material 50 has treated with alkali, the release component 61 contains ammonium ion in some cases depending on time elapsing from the beginning of the collection step of a flavor constituent (treatment time). The release component 61 contains TSNA in some cases depending on time elapsing from the beginning of the collection step (treatment time).

A release section 23 is provided on the tip of the pipe 22 and immersed in the collection solvent 70. The release section 23 has a plurality of openings 23A. The release component 61 taken by the pipe 22 is released in the collection solvent 70 from a plurality of openings 23A as a foam-like release component 62.

The pipe 24 takes a residual component 63 which has not been captured by the collection solvent 70 to the outside of the container 21.

Since the release component 62 is a component which is released in the gas phase by heating the tobacco raw material 50, there is a possibility that the temperature of the collection solvent 70 is raised by the release component 62. Therefore, the collection device 20 may have a function for cooling the collection solvent 70 to maintain the temperature of the collection solvent 70 to normal temperature.

The collection device 20 may have a raschig ring to increase the contact area of the release component 62 with the collection solvent 70.

Application Example

Figure 3:
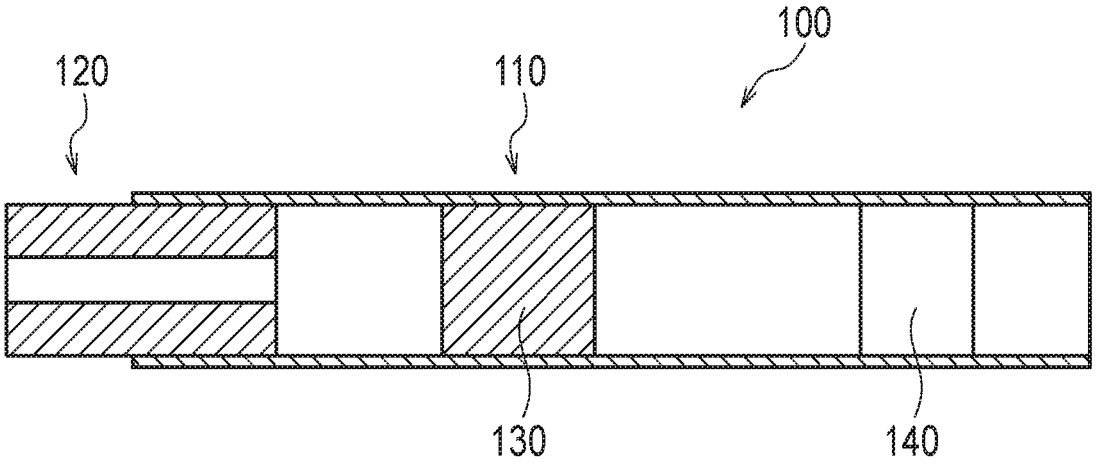
FIG. 3 is a diagram illustrating an example of the application of a flavor constituent.

An example of the application of a flavor constituent extracted from the tobacco raw material 50 will be described below. FIG. 3 is a diagram illustrating an example of the application of a flavor constituent. For example, a flavor constituent is provided for a constituent of a favorite item (e.g. a flavor source for a flavor inhaler).

As shown in FIG. 3, a flavor inhaler 100 has a holder 110, a carbon heat source 120, a flavor source 130 and a filter 140.

The holder 110 is for example a paper pipe with a tubular shape. The carbon heat source 120 generates heat to heat the flavor source 130. The flavor source 130 is a substance to generate a flavor and is an example of a base material for a flavor source for which a flavor constituent is provided. The filter 140 inhibits the introduction of impurity substances to the mouthpiece side.

The flavor inhaler 100 is described herein as an example of the application of a flavor constituent, but the embodiments are not limited thereto. A flavor constituent may be applied to other inhalers, for example, an aerosol source for electronic cigarettes (what is called E-liquid). In addition, a flavor constituent may be provided for base materials for a flavor source such as gum, tablets, films and candy.

(Producing Method)

Figure 4:
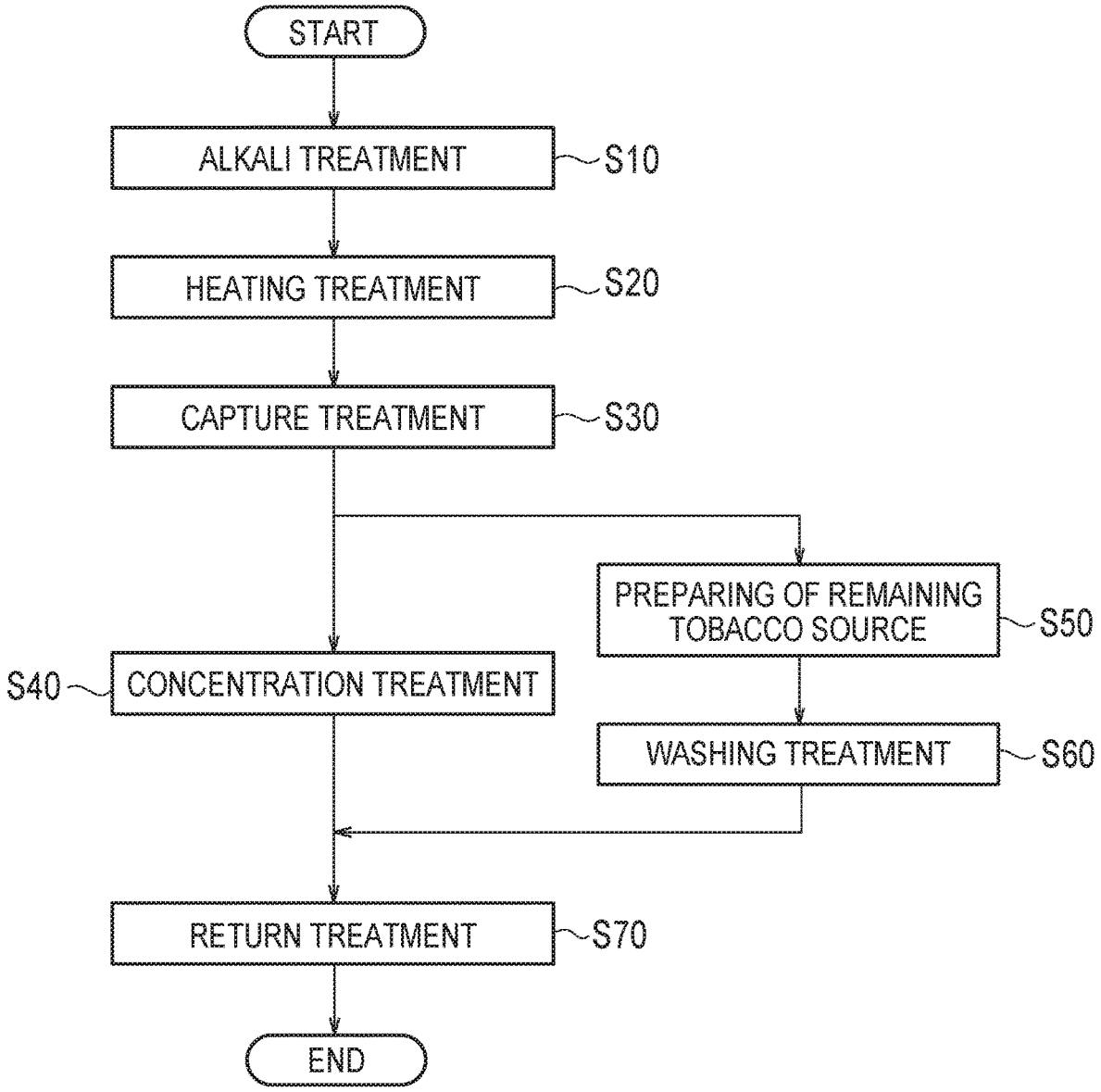
FIG. 4 is a flow diagram showing the production method in the first embodiment.

The method for producing a tobacco raw material involved in the first embodiment will be described below. FIG. 4 is a flow diagram showing the production method involved in the first embodiment.

As shown in FIG. 4, an alkaline substance is provided for the tobacco raw material 50 using the above-described treatment device 10 in Step S10. As the alkaline substance, for example, a basic substance such as an aqueous solution of potassium carbonate can be used.

It is preferred that the initial amount of flavor constituent (herein, a nicotine component) contained in the tobacco raw material 50 be 2.0 wt % or more in the case where the gross weight of the tobacco raw material 50 in the dry state is 100 wt %. It is further preferred that the initial amount of flavor constituent (herein, a nicotine component) contained be 4.0 wt % or more.

The pH of the tobacco raw material 50 after an alkali treatment is preferably 8.0 or more as described above. Further preferably, the pH of the tobacco raw material 50 after an alkali treatment is preferably in a range from 8.9 to 9.7.

In Step S20 (i.e. step A1 or step A2), the tobacco raw material 50 which has been treated with alkali is heated in a closed space (in the above-described container 11 in the embodiment) to take a flavor constituent which is released in the gas phase from the tobacco raw material 50 to the outside of the closed space. In the heating treatment, for example, the tobacco raw material 50 can be heated with the container 11 with the tobacco raw material 50 put in the container 11 in the treatment device 10. In such case, it is needless to say that the pipe 22 in the collection device 20 is attached to the container 11.

The heating temperature of the tobacco raw material 50 is in a range from 80° C. or more to less than 150° C. By setting the heating temperature of the tobacco raw material 50 to 80° C. or more, a time when a flavor constituent is sufficiently released from the tobacco raw material 50 can be earlier. By setting the heating temperature of the tobacco raw material 50 to less than 150° C., meanwhile, a time when TSNA is released from the tobacco raw material 50 can be delayed.

The tobacco raw material 50 may be subjected to a water addition treatment before heating the tobacco raw material 50. Such water addition treatment may be carried out in Step S10 or may be carried out before heating the tobacco raw material 50 in Step S20. Alternatively, the water addition treatment may be carried out in the process of heating the tobacco raw material 50 in Step S20 to supplement water which decreases by heating the tobacco raw material 50 in Step S20. In such case, the water addition treatment may be intermittently carried out at least once or more. Alternatively, the water addition treatment may be successively carried out over a predetermined period. The amount of water in the tobacco raw material 50 before heating the tobacco raw material 50 is preferably 30 wt % or more. The upper limit of the amount of water in the tobacco raw material 50 is not particularly limited, and for example preferably 50 wt % or less to efficiently heat the tobacco raw material 50.

In addition, Step S20 (heating treatment) preferably comprises the step for adding a non-aqueous solvent to the tobacco raw material 50. The amount of non-aqueous solvent is preferably 10 wt % or more and 50 wt % or less with respect to the tobacco raw material 50. Because of this, impurity substances soluble in such non-aqueous solvent under the heating condition move from the tobacco raw material 50 to the non-aqueous solvent through the liquid phase, and thus the impurity substances can be efficiently removed in Step S60 (washing treatment) described below. The non-aqueous solvent may be a solvent other than water. Specific examples of non-aqueous solvents include glycerin, propylene glycol, ethanol, alcohol, acetonitrile, hexane and the like. In the step for adding a non-aqueous solvent to the tobacco raw material 50, the non-aqueous solvent and further water may be added to the tobacco raw material 50.

The time for adding a non-aqueous solvent to the tobacco raw material 50 may be a time before Step S20 (heating treatment) is completed. For example, the time for adding a non-aqueous solvent to the tobacco raw material 50 may be a time between Step S10 (alkali treatment) and Step S20 (heating treatment). Alternatively, the time for adding a non-aqueous solvent to the tobacco raw material 50 may be a time in the process of Step S20 (heating treatment). In addition, the non-aqueous solvent is preferably a solvent which is not substantially vaporized at the heating temperature in Step S20 (heating treatment). Because of this, such non-aqueous solvent and impurity substances dissolved in the non-aqueous solvent can be inhibited from contaminating a capture solvent in Step S30 described below.

When the tobacco raw material 50 is heated in Step S20, the tobacco raw material 50 may be subjected to a water addition treatment. The amount of water in the tobacco raw material 50 is preferably maintained to 10% or more and 50% or less by the water addition treatment. In Step 20, water may be successively added to the tobacco raw material 50. The amount of water added is preferably adjusted so that the amount of water in the tobacco raw material 50 is 10% or more and 50% or less. Further, the above-described non-aqueous solvent may be added to the tobacco raw material 50 during the water addition treatment.

It is also preferred that the tobacco raw material 50 be subjected to an aeration treatment in Step S20. Therefore, the amount of flavor constituent contained in the release component 61 which is released in the gas phase from the alkali-treated tobacco raw material 50 can be increased. In the aeration treatment, for example, saturated water vapor at 80° C. is brought into contact with the tobacco raw material 50. The aeration time in the aeration treatment varies depending on a device for treating the tobacco raw material 50 and the amount of tobacco raw material 50, and thus cannot be necessarily specified, and for example, the aeration time is within 300 minutes when the tobacco raw material 50 is 500 g. The gross aeration volume in the aeration treatment also varies depending on a device for treating the tobacco raw material 50 and the amount of tobacco raw material 50, and thus cannot be necessarily specified, and for example, the volume is about 10 L/g when the tobacco raw material 50 is 500 g.

Air used in the aeration treatment is not necessarily saturated water vapor. The amount of water in air used in the aeration treatment may be adjusted so that water contained in the tobacco raw material 50 to which the heating treatment and the aeration treatment have been applied is for example less than 50% without particularly requiring the humidification of the tobacco raw material 50. The gas used in the aeration treatment is not limited to air and may be inert gases such as nitrogen and argon.

In Step S30 (i.e. step B1 or B2), a flavor constituent which has been released in the gas phase in Step S20 is brought into contact with the capture solvent 70 (a first solvent) which is a liquid substance at normal temperature on the outside of the closed space (the outside of the above-described container 11 in the embodiment), that is, in the collection device 20 in the embodiment to allow the capture solvent 70 to capture the flavor constituent. It should be noted that Step S20 and Step S30 are shown as different treatments in FIG. 4 for the convenience of illustration, but Step S20 and Step S30 are treatments which are carried out in parallel. Being carried out in parallel means that the period to carry out Step S30 overlaps with the period to carry out Step S20, and it should be noted that Step S20 and Step S30 do not need to start and finish at the same time.

In Step S20 and Step S30, the pressure in the container 11 in the treatment device 10 is not more than normal pressure. Specifically, the upper limit of the pressure in the container 11 in the treatment device is +0.1 MPa or less as gauge pressure. In addition, a reduced pressure atmosphere may be inside the container 11 in the treatment device 10.

As the collection solvent 70, for example, glycerin, water or ethanol can be used as described above. The temperature of the collection solvent 70 is normal temperature as described above. The lower limit of normal temperature is for example a temperature at which the collection solvent 70 is not solidified, preferably 10° C. The upper limit of normal temperature is for example 40° C. or less.

In Step S40, in order to increase the concentration of a flavor constituent contained in a collection solution, the capture solvent 70 having captured the flavor constituent is subjected to a vacuum concentration treatment, a heating concentration treatment or a salting-out treatment. It should be noted however that the treatment of Step S40 (concentration treatment) is not essential and may be omitted.

The vacuum concentration treatment is preferably carried out in an airtight space to a degree in which the movement of air to the outside of the space can be inhibited. Because of this, contact with air is limited, and it is not required that the capture solvent 70 be raised to a high temperature, and thus there is a little concern about changes in components. Therefore, types of capture solvent which can be used increase by using vacuum concentration.

In the heating concentration treatment, there is concern about liquid denaturation, for example, oxidation of a flavor constituent, but there is a possibility that an effect for increasing a flavor is obtained. However, compared to the vacuum concentration, types of collection solvent which can be used are decreased. There is for example a possibility that a collection solvent having an ester structure such as MCT (Medium Chain Triglyceride) cannot be used.

In the salting-out treatment, compared to the vacuum concentration treatment, the concentration of a flavor constituent can be increased; however, the flavor constituent is divided fifty-fifty between the liquid solvent phase/water phase, and thus the yield rate of the flavor constituent is low. In addition, it is supposed that the coexistence of a hydrophobic substance (such as MCT) is essential, and thus there is a possibility that salting-out does not occur depending on the ratio between capture solvent, water and flavor constituent.

In Step S50, the tobacco raw material 50 which a flavor constituent has been released in Step S20 is prepared. It should be noted that the tobacco raw material 50 is still maintained in the closed space (in the above-described container 11 in the embodiment).

In Step S60 (i.e. step C2), a washing solvent (a second solvent) is supplied to the tobacco raw material 50 in the closed space (in the above-described container 11 in the embodiment), and a normal component which is released as the liquid phase from the tobacco raw material 50 to the washing solvent is taken with the washing solvent to the outside of the closed space (the outside of the above-described container 11 in the embodiment).

After a flavor constituent which has been contained in the tobacco raw material 50 is taken out in Step S30 (capture treatment), the residue from which the flavor constituent has been taken is washed with a washing solvent in Step S60 (washing treatment). Because of this, impurity substances remaining in the tobacco raw material 50 (residue) are removed. Since the production method involved in the embodiment comprises Step S60 (washing treatment), unnecessary impurity substances can be simply removed from the tobacco raw material 50 (residue).

In the case where Step S60 (washing treatment) is carried out following Step S30 (capture treatment) using the treatment device 10, examples of washing modes can include a mode in which a washing solvent is sprayed to the tobacco raw material 50 (residue) from the spray 12 and then the container 11 is rotated and shaken for about 10 to 60 minutes to carry out washing.

At this time, the weight ratio of tobacco raw material 50 (residue) and washing solvent (washing solvent/residue) can include 10 to 20 when the tobacco raw material 50 (residue) is considered as 1.

The washing solvent used in Step S60 (washing treatment) can include aqueous solvents, and specific examples thereof can be pure water and ultrapure water, and can include city water. In addition, the temperature of the washing solvent can include between normal temperature (e.g. 20° C.±15° C.) and 70° C.

In the case where an aqueous solvent is used as a washing solvent, those through which $CO_2$ gas is bubbled may be used, and specifically can include carbonated water and an aqueous solution containing oversaturated $CO_2$ gas. In addition, an aqueous solvent, for example, water through which ozone is bubbled can be used.

Step S60 (washing treatment) may be repeated at least twice or more. In such case, when n is an integer of 1 or more, a solvent A is used as a washing solvent in the n-th step, and a solvent B different from the solvent A may be used as a washing solvent in the n+1-th step. In the case where Step S60 (washing treatment) is repeated 3 times or more, three types or more of solvent may be used as a washing solvent. Further, when Step S60 (washing treatment) is repeated 3 times or more, the same solvent may be used in Step S60 (washing treatment) twice or more.

For example, when an aqueous solvent is used as a washing solvent, washing is initially carried out with water, and then washing may be carried out with an aqueous solvent through which $CO_2$ gas is bubbled. Each washing may be carried out several times. When washing is carried out by such procedure and aqueous solvent, impurity substances are efficiently removed.

As the washing solvent, non-aqueous solvents such as propylene glycol, glycerin, ethanol, MCT), hexane, methanol and acetonitrile can be also used aside from the above-mentioned aqueous solvents. In addition, these can be used by mixing the above-mentioned aqueous solvents.

After washing with a washing solvent, the residue may be subjected to a drying treatment. As the drying condition, an mode in which drying is carried out at a temperature of about 110 to 125° C. for about 100 to 150 minutes with air circulated (ventilation amount 10 to 20 L/min/250 g) can be mentioned.

As described above, when Step S60 (washing treatment) is repeated several times, by using different types of washing solvent for each washing treatment, types of impurity component can be differentiated due to high affinity with a washing solvent, and several types of impurity component can be removed.

The residue obtained after the washing treatment in Step S60 (washing treatment) is used for Step S70 (return treatment) described below.

In Step S70 (i.e. step C1 or step D2), a capture solvent (first solvent) having captured a flavor constituent in Step S30 is added to the tobacco raw material 50 which the flavor constituent has been released in a closed space in Step S20 (the washed residue of the tobacco raw material) in the closed space (in the above-described container 11 in the embodiment). The capture solvent (first solvent) which is added to the tobacco raw material 50 (the washed residue of the tobacco raw material) may be neutralized in Step S70. Alternatively, after adding the capture solvent (first solvent) to the tobacco raw material 50 (the washed residue of the tobacco raw material) in Step S70, the tobacco raw material containing a flavor constituent may be neutralized.

By the treatments described above, a tobacco raw material containing a flavor constituent is produced. However, the treatment in Step S40 (concentration treatment) may be omitted as described above.

It should be noted that the entire above-described wt % is percent by weight in the dry state.

(Action and Effect)

In the first embodiment, a capture solvent is allowed to capture a flavor constituent contained in a tobacco raw material by Step S20 (heating treatment) and Step S30 (capture treatment), and by carrying out Step S70 (return treatment) for adding the capture solvent having captured the flavor constituent to a tobacco raw material, impurities such as ammonia contained in the tobacco raw material can be selectively reduced by a simple and low-cost process.

Further, in the first embodiment, Step S60 (washing treatment) for washing a tobacco raw material is carried out prior to Step S70 (return treatment) for adding a capture solvent having, captured a flavor constituent to a tobacco raw material. Because of this, impurity components such as TSNA are further selectively reduced.

In the first embodiment, because Step S20 (heating treatment), Step S60 (washing treatment) and Step S70 (return treatment) are carried out with the tobacco raw material maintained in a closed space (in the above-described container 11 in the embodiment), the tobacco raw material is maintained in a sanitary condition, and the vaporization of a flavor constituent contained in the tobacco raw material is inhibited, and it is not required to transfer the tobacco raw material. Therefore the loss of the tobacco raw material is limited.

Modified Example 1

The modified example 1 of the first embodiment will be described below. Differences from the first embodiment will be mainly described below.

In the modified example 1, the above-described Step S30 (capture treatment) is carried out until any time from when the first condition is satisfied to when the second condition is satisfied.

The first condition is a condition that when, after the pH of a collection solution containing the capture solvent 70 and the release component 62 decreases by 0.2 or more from the maximum value, a stable zone in which variations in the pH of the collection solution are within a predetermined range exists in the time axis elapsing from the beginning of Step S20, the time elapsing from the beginning of Step S20 (hereinafter, treatment time) reaches the start time of the stable zone.

The stable zone is a zone in which variations in the pH of a collection solution are within a predetermined range (e.g. the average variation per unit of time is ±0.01/min), and in such zone, the range of variation in the pH of a collection solution is within a predetermined range (e.g. a difference between pH at a time when such zone starts and pH at a time when the second condition described below is satisfied is ±0.2). In a case where a stable zone in which variations in the pH of a collection solution are within a predetermined range exists after the pH of the collection solution decreases by 0.2 or more from the maximum value, the start time of the stable zone is for example a time when the pH of the collection solution stops decreasing.

The profile of the pH of a collection solution is measured in advance in the same conditions as in the actual treatments, and the pH of a collection solution is preferably replaced with treatment time. That is, the first condition is preferably replaced with treatment time. Because of this, it is not required to monitor variations in the pH of a collection solution in real time and ammonium ion ($NH_4^+$) can be removed from the collection solution by simple control.

The second condition is a condition that, in the case where the weight of the tobacco raw material 50 in the dry state is 100 wt %, the remaining amount of flavor constituent (herein, a nicotine component) contained in the tobacco raw material 50 decreases until reaching 0.3 wt %. Further preferably, the second condition is a condition that, in the case where the weight of the tobacco raw material 50 in the dry state is 100 wt %, the remaining amount of flavor constituent (herein, a nicotine component) contained in the tobacco raw material 50 decreases until reaching 0.4 wt %. Further preferably, the second condition is a condition that, in the case where the weight of the tobacco raw material 50 in the dry state is 100 wt %, the remaining amount of flavor constituent (herein, a nicotine component) contained in the tobacco raw material 50 decreases until reaching 0.6 wt %.

The profile of the remaining amount of flavor constituent (herein, a nicotine component) contained in the tobacco raw material 50 is measured in advance in the same conditions as in the actual treatments, and the remaining amount of flavor constituent is preferably replaced with treatment time. That is, the second condition is preferably replaced with treatment time. Because of this, it is not required to monitor the remaining amount of flavor constituent in real time and an increase in the amount of TSNA contained in a capture solvent can be inhibited by simple control.

In the modified example 1, the total amount of saccharides contained in the tobacco raw material 50 is 10.0 wt % or less in the case where the gross weight of the tobacco raw material 50 in the dry state is 100 wt %. The saccharides contained in the tobacco raw material 50 are fructose, glucose, saccharose, maltose and inositol. Because of this, the stable zone of pH showing that the concentration of ammonium ion in a collection solution was sufficiently reduced can be clearly confirmed.

(Action and Effect)

In the modified example 1, Step S30 for bringing a release component into contact with the capture solvent 70 is continued at least until the first condition is satisfied. Because of this, ammonium ion ($NH_4^+$) contained in the release component is sufficiently removed from the collection solution. In addition, in the release from the tobacco raw material 50 and the extraction by a capture solvent, other volatile impurity components (specifically, acetaldehyde, pyridine) showing the same behavior as of ammonium ion are also removed from a collection solution by satisfying the first condition.

In the meantime, Step S30 for bringing a release component into contact with the capture solvent 70 is finished at least by the time when the second condition is satisfied. Because of this, by finishing S30 prior to the amount of TSNA released increases, an increase in the amount of TSNA contained in a collection solution is inhibited.

As described above, by simple treatments such as Step S20 and Step S30, as contamination by impurity components such as ammonium ion ($NH_4^+$) and TSNA is inhibited, a flavor constituent can be sufficiently extracted. That is, a flavor constituent can be extracted by a simple device.

In the modified example 1, non-volatile components contained in the tobacco raw material 50 do not move to a capture solvent, and only components volatilized at about 120° C. can be collected in the capture solvent, and thus components collected by a capture solvent can be used as an aerosol source for electronic cigarettes. Because of this, as an increase in volatile impurity components such as ammonium ion, acetaldehyde and pyridine is inhibited in electronic cigarettes, aerosol containing a tobacco flavor can be delivered to users, and further the movement of non-volatile components to the capture solvent is inhibited, and thus scorching of a heater to heat an aerosol source, and the like can be inhibited. The term "electronic cigarette" herein indicates a non-combustion type flavor inhaler or aerosol inhaler which comprises an electric heater to heat and atomize a liquid aerosol source and an aerosol source and is to deliver aerosol to users (e.g. an aerosol inhaler described in Japanese Patent No. 5196673, an aerosol electronic cigarette described in Japanese Patent No. 5385418, etc.)

Modified Example 2

The modified example 2 of the first embodiment will be described below. Differences from the first embodiment will be mainly described below.

In the modified example 2, the above-described Step S30 (capture treatment) is carried out until any time from when the first condition is satisfied to when the second condition is satisfied.

The first condition is a condition that, in the case where the weight of the tobacco raw material in the dry state is 100 wt %, the remaining amount of flavor constituent (herein, a nicotine component) contained in the tobacco raw material decreases until reaching 1.7 wt %.

The second condition is a condition that, in the case where the weight of the tobacco raw material 50 in the dry state is 100 wt %, the remaining amount of flavor constituent (herein, a nicotine component) contained in the tobacco raw material 50 decreases until reaching 0.3 wt %. Further preferably, the second condition is a condition that, in the case where the weight of the tobacco raw material 50 in the dry state is 100 wt %, the remaining amount of flavor constituent (herein, a nicotine component) contained in the tobacco raw material 50 decreases until reaching 0.4 wt %. Further preferably, the second condition is a condition that, in the case where the weight of the tobacco raw material 50 in the dry state is 100 wt %, the remaining amount of flavor constituent (herein, a nicotine component) contained in the tobacco raw material 50 decreases until reaching 0.6 wt %.

The profile of the remaining amount of flavor constituent (herein, a nicotine component) contained in the tobacco raw material 50 is measured in advance in the same conditions as in the actual treatments, and the remaining amount of flavor constituent is preferably replaced with treatment time. That is, the second condition is preferably replaced with treatment time. Therefore, it is not required to monitor the remaining amount of flavor constituent in real time and an increase in the amount of TSNA contained in a collection solvent can be inhibited by simple control.

(Action and Effect)

In the modified example 2, Step S30 for bringing a release component into contact with the capture solvent 70 is continued at least until the first condition is satisfied. Because of this, Step S30 is continued in a zone in which the decrease rate of the remaining amount of flavor constituent contained in a tobacco raw material (i.e. a rate at which a nicotine component is volatilized from the tobacco raw material 50) is not less than a predetermined rate, and therefore the flavor constituent can be efficiently recovered. In the meantime, Step S30 for bringing a release component into contact with the capture solvent 70 is finished at least by the time when the second condition is satisfied. Because of this, by finishing S30 before the amount of TSNA released increases, an increase in the amount of TSNA contained in a collection solution is inhibited.

As described above, by the simple treatments such as Step S20 and Step S30, as contamination by impurity components such as TSNA is inhibited, a flavor constituent can be sufficiently extracted. That is, a flavor constituent can be extracted by a simple device.

In the modified example 2, non-volatile components contained in the tobacco raw material 50 do not move to a collection solvent, and only components volatilized at about 120° C. can be collected in the collection solvent, and thus components collected by a collection solvent can be used as an aerosol source for electronic cigarettes. Because of this, as an increase in volatile impurity components such as ammonium ion, acetaldehyde and pyridine is inhibited in electronic cigarettes, aerosol containing a tobacco flavor can be delivered to users, and further the movement of non-volatile components to a capture solvent is inhibited, and thus scorching of a heater to heat an aerosol source, and the like can be inhibited. The term "electronic cigarette" herein indicates a non-combustion type flavor inhaler or aerosol inhaler which comprises an electric heater to heat and atomize a liquid aerosol source and an aerosol source and is to deliver aerosol to users (e.g. an aerosol inhaler described in Japanese Patent No. 5196673, an aerosol electronic cigarette described in Japanese Patent No. 5385418, etc.).

[Experimental Results]

(First Experiment)

In the first experiment, samples (Sample A to Sample D) shown in FIG. 5 were prepared and the pH of a collection solution and ammonium ion ($NH_4^+$) contained in a collection solution were measured under the following conditions.

Figure 6:
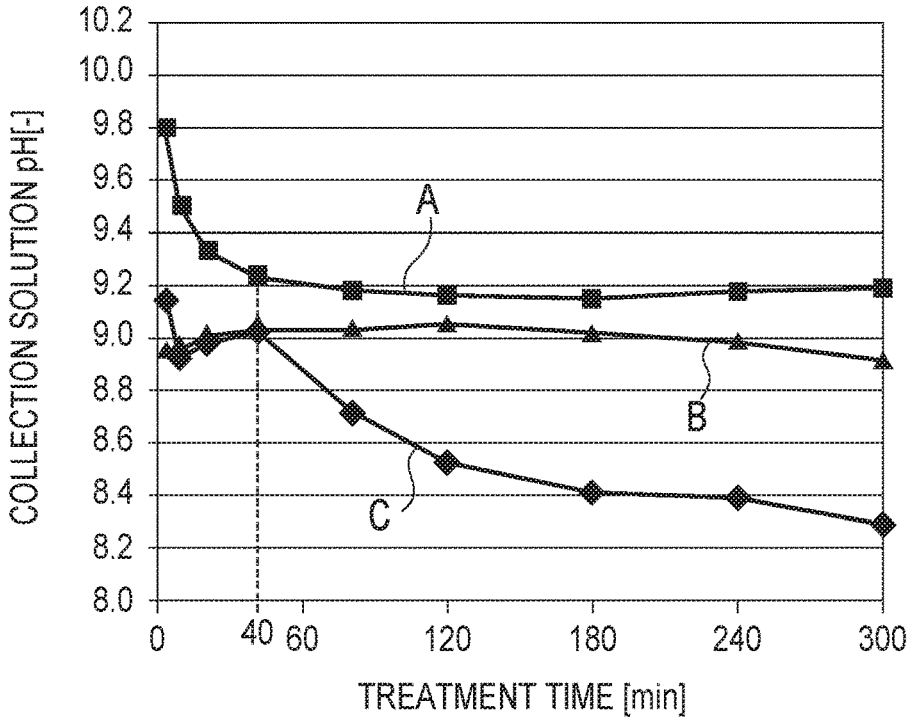
FIG. 6 is a diagram illustrating the first experiment.
Figure 7:
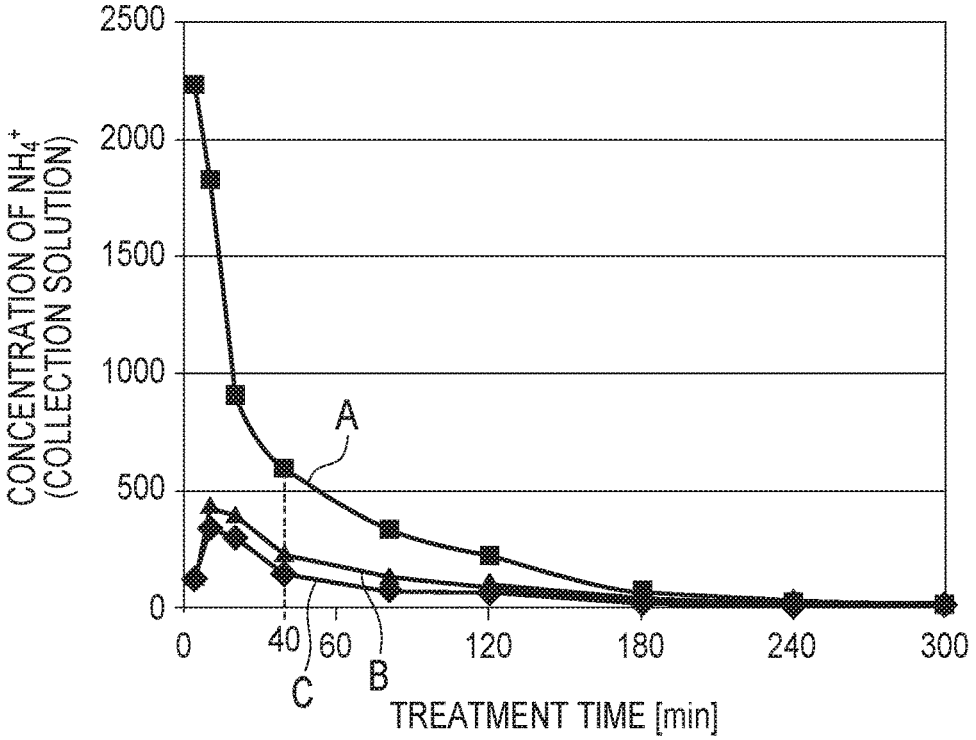
FIG. 7 is a diagram illustrating the first experiment.

The amount of nicotine (Nic. amount) and the amount of ammonium ion ($NH_4^+$ amount) contained in Sample A to Sample D in the dry state are as shown in FIG. 5. The amount of every saccharide (fructose, glucose, saccharose, maltose and inositol) contained in Sample A is almost zero (less than the detection limit), the total amount of saccharides (fructose, glucose, saccharose, maltose and inositol) contained in Sample B is 9.37 wt %, the total amount of saccharides (fructose, glucose, saccharose, maltose and inositol) contained in Sample C is 18.81 wt %, and the amount of saccharides (fructose, glucose, saccharose, maltose and inositol) contained in Sample D is 0.02 wt %. In addition, the measurement results of the pH of a collection solution are as shown in FIG. 6, and the measurement results of ammonium ion ($NH_4^+$) contained in a collection solution are as shown in FIG. 7. In FIG. 6 and FIG. 7, the treatment time is a time elapsing from the beginning of the heating treatment (S20) of a tobacco raw material. It can be thought that the treatment time is a time elapsing from the beginning of the collection treatment (S30) of a flavor constituent (hereinafter, a nicotine component).

—Experimental Conditions—

Heating temperature of tobacco raw material: 120° C.
pH of tobacco raw material after alkali treatment: 9.6
Initial amount of water in tobacco raw material after alkali treatment: 39%±2%
Type of capture solvent: glycerin
Temperature of capture solvent: 20° C.
Amount of capture solvent: 61 g
Aeration flow during bubbling treatment (aeration treatment and collection treatment): 15 L/min The gas used in the bubbling treatment (aeration treatment) is the atmosphere at about 20° C. and about 60%-RH.

It was verified that in the profile of the pH of a collection solution, a stable zone in which variations in the pH of a collection solution are within a predetermined range existed after the pH of the collection solution decreased by 0.2 or more from the maximum value in Sample A as shown in FIG. 6. It was verified that the concentration of ammonium ion ($NH_4^+$) contained in a collection solution was sufficiently reduced at a time when the stable zone starts (e.g. treatment time=40 minutes) as shown in FIG. 7.

On the other hand, it was verified that in the profile of the pH of a collection solution, a zone in which the pH of a collection solution decreases by 0.2 or more from the maximum value did not exist in Sample B as show in FIG. 6. It was verified that in the profile of the pH of a collection solution, the pH of a collection solution was intermittently reduced and the above-described stable zone did not exist in Sample C as shown in FIG. 6.

The stable zone is a zone in which variations in the pH of a collection solution is within a predetermined range (e.g. the average variation per unit of time is ±0.01/min) as described above, and in such zone, the range of variation in the pH of a collection solution is within a predetermined range (e.g. a difference between pH at a time when such zone starts and pH at a time when the second condition described below is satisfied is ±0.2).

It was verified that by the heating treatment and the collection treatment, saccharides (fructose, glucose, saccharose, maltose and inositol) contained in a tobacco raw material decreased and volatile organic acids (acetic acid, formic acid) increased. In addition, the increased amount of volatile organic acids was Sample C>Sample B>Sample A, and it was verified that in a sample with a higher amount of saccharides contained in a tobacco raw material, the increased amount of volatile organic acids was higher. It is thought that this is because acid substances are produced by degradation of saccharides and move to a collection solution. In other words, it was verified that by using a burley type tobacco raw material with a low amount of saccharides contained in the tobacco raw material like Sample A, specifically a tobacco raw material in which the total amount of saccharides contained in the tobacco raw material is 10.0 wt % or less, the stable zone of pH showing that the concentration of ammonium ion in a collection solution was sufficiently reduced could be clearly confirmed. In addition, by daring to use a burley type tobacco raw material with a high concentration of ammonium ion ($NH_4^+$) a profile with a pH decrease is easily confirmed. Furthermore, by the reducing treatment of ammonium ion ($NH_4^+$), volatile impurity components (specifically, acetaldehyde, pyridine) showing the same release and collection behavior as of ammonium ion ($NH_4^+$) are also reduced at the same time, and thus volatile impurity components (specifically, acetaldehyde, pyridine) are easily reduced.

Such experimental results verified that in a case where, after the pH of a collection solution decreased by 0.2 or more from the maximum value, a stable zone in which variations in the pH of a collection solution are within a predetermined range existed in the profile of the pH of a collection solution like Sample A, when the treatment time went through the start time of the stable zone, the concentration of ammonium ion ($NH_4^+$) was sufficiently reduced. That is, it was verified that preferably the first condition was a condition that the treatment time reaches the start time of the stable zone.

(Second Experiment)

In the second experiment, a sample of burley type tobacco raw material (the above-described Sample A) was prepared, and the remaining amount of alkaloid (herein, a nicotine component) contained in the tobacco raw material in the dry state (hereinafter, nicotine concentration in tobacco raw material), and the concentration of TSNA contained in a collection solution (hereinafter, TSNA concentration in collection solution) were measured under the following conditions.

Figure 8:
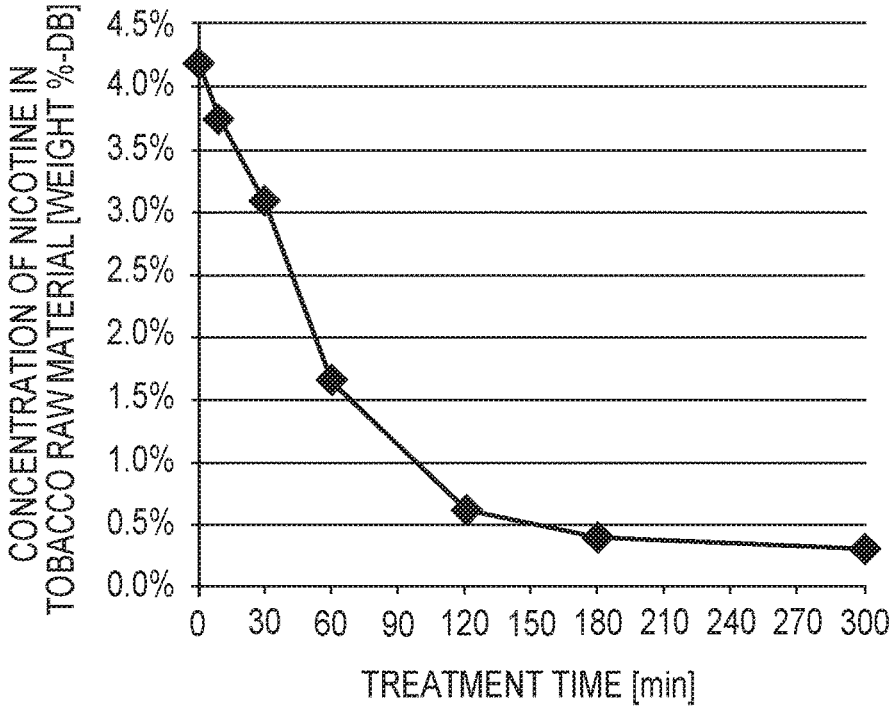
FIG. 8 is a diagram illustrating the second experiment.
Figure 9:
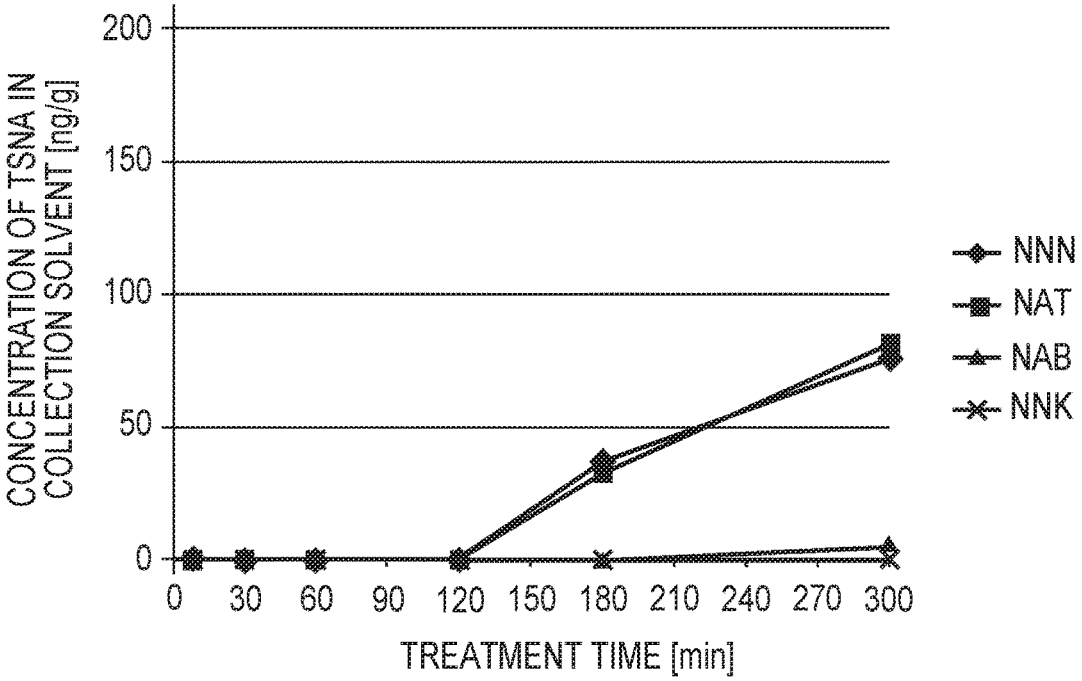
FIG. 9 is a diagram illustrating the second experiment.

The measurement results of the nicotine concentration in tobacco raw material are as shown in FIG. 8, and the measurement results of the concentration of TSNA contained in a collection solution are as shown in FIG. 9. The remaining amount of nicotine component contained in a tobacco raw material is represented by percent by weight in a case where the weight of a tobacco raw material in the dry state is 100 wt %. The concentration of TSNA contained in a collection solution is represented by percent by weight in a case where a collection solution is 100 wt %. In FIG. 8 and FIG. 9, the treatment time is a time elapsing from the beginning of the heating treatment (S20) of a tobacco raw material. It can be also thought that the treatment time is a time elapsing from the beginning of the collection treatment (S30) of a nicotine component.

About four types of TSNA, 4-(methylnitrosamino)-1-(3-pyridyl)-1-butanone (hereinafter, NNK), N'-nitrosonornicotine (hereinafter, NNN), N'-nitrosoanatabine (hereinafter, NAT) and N'-nitrosoanabasine (hereinafter, NAB), these concentrations were measured.

—Experimental Conditions—

Heating temperature of tobacco raw material: 120° C.
pH of tobacco raw material after alkali treatment: 9.6
Initial amount of water in tobacco raw material after alkali treatment: 39%±2%
Type of capture solvent: glycerin
Temperature of capture solvent: 20° C.
Amount of capture solvent: 60 g
Aeration flow during bubbling treatment (aeration treatment and collection treatment): 15 L/min The gas used in the bubbling treatment (aeration treatment) is the atmosphere at about 20° C. and about 60%-RH.

As shown in FIG. 8, the remaining amount of nicotine component contained in a tobacco raw material intermittently decreases in the profile of the nicotine concentration in tobacco raw material. As shown in FIG. 9, it was verified that NNK did not change but NNN, NAT and NAB increased after a lapse of a fixed period in the profile of the concentration of TSNA.

Specifically, it was verified that when the treatment time went through a time when the nicotine concentration in tobacco raw material reaches 0.3 wt % (300 minutes in the present experimental result), the decrease rate of the remaining amount of nicotine component contained in a tobacco raw material (i.e. a rate at which the nicotine component is volatilized from the tobacco raw material) declined, and a rise in the recovery rate of nicotine component was not expected. It was also verified that when the treatment time went through a time when the nicotine concentration in tobacco raw material reaches 0.4 wt % (180 minutes in the present experimental result), NAB gradually increased. It was further verified that when the treatment time went through a time when the nicotine concentration in tobacco raw material reaches 0.6 wt % (120 minutes in the present experimental result), NNN and NAT considerably increased.

Such experimental results verified that preferably the heating treatment (S20) and the collection treatment (S30) were finished before the time when the nicotine concentration in tobacco raw material reaches 0.3 wt %. That is, it was verified that preferably the second condition was that the nicotine concentration in tobacco raw material decreases until reaching 0.3 wt %. It was verified that further preferably the heating treatment (S20) and the collection treatment (S30) were finished before the time when the nicotine concentration in tobacco raw material reaches 0.4 wt %. That is, it was verified that further preferably the second condition was that the nicotine concentration in tobacco raw material decreases until reaching 0.4 wt %. It was verified that further preferably the heating treatment (S20) and the collection treatment (S30) were finished before the time when the nicotine concentration in tobacco raw material reaches 0.6 wt %. That is, it was verified that further preferably the second condition was that the nicotine concentration in tobacco raw material decreases until reaching 0.6 wt %.

(Third Experiment)

Figure 10:
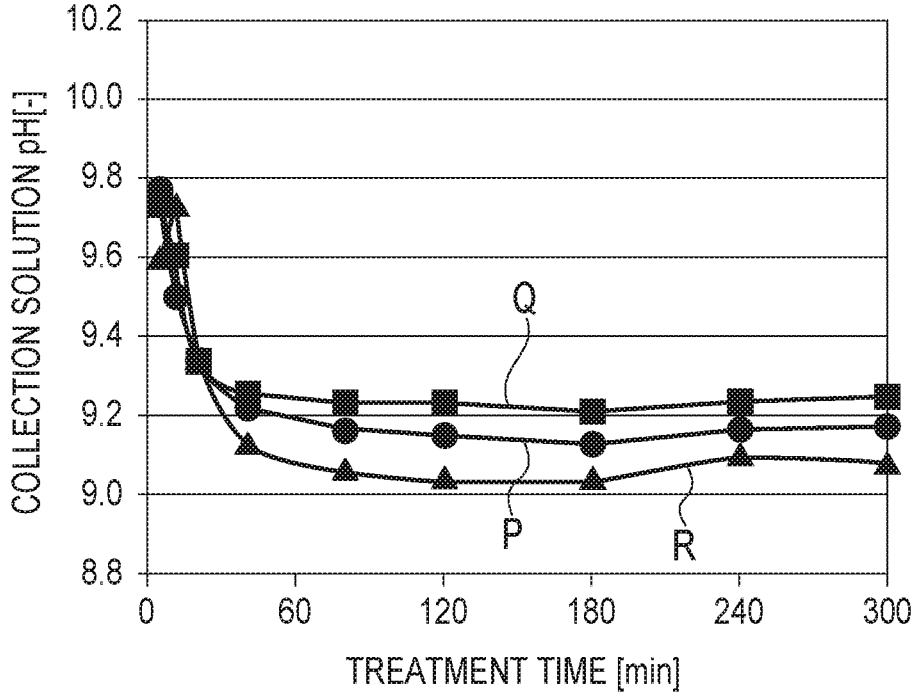
FIG. 10 is a diagram illustrating the third experiment.
Figure 11:
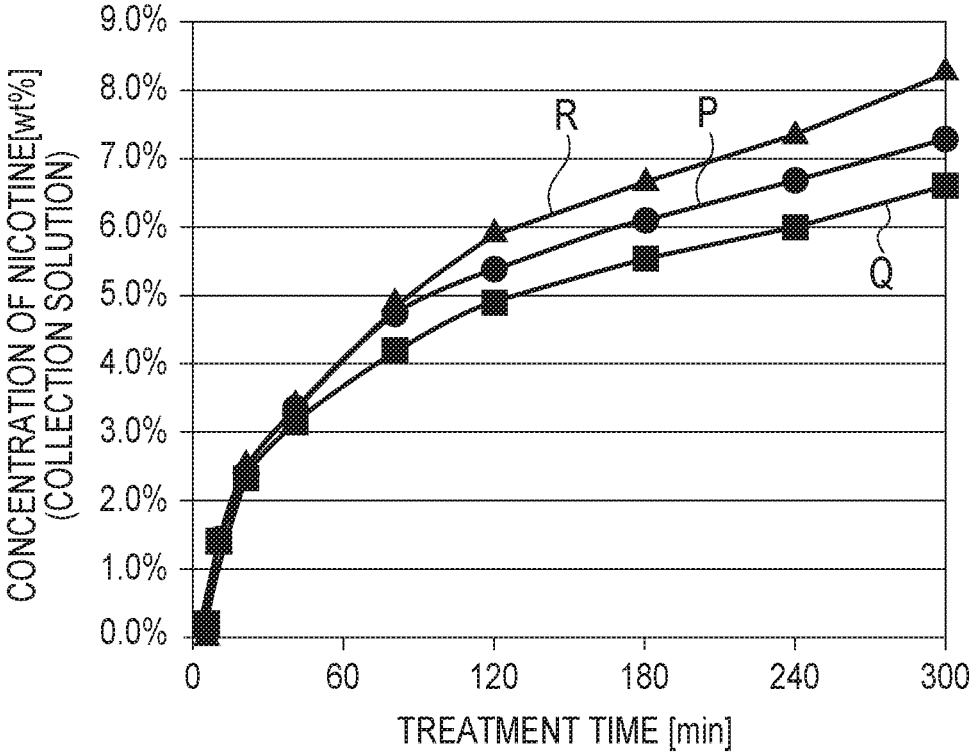
FIG. 11 is a diagram illustrating the third experiment.

In the third experiment, Sample P to Sample Q were prepared and the pH of a collection solution and the concentration of alkaloid (herein, a nicotine component) in a collection solution were measured under the following conditions. Sample P is a sample using glycerin as a collection solvent. Sample Q is a sample using water as a collection solvent. Sample R is a sample using ethanol as a collection solvent. The measurement results of the pH of a collection solution are as shown in FIG. 10. The measurement results of the concentration of nicotine component contained in a collection solution are as shown in FIG. 11. In FIG. 10 and FIG. 11, the treatment time is a time elapsing from the beginning of the heating treatment (S20) of a tobacco raw material. It can be thought that the treatment time is a time elapsing from the beginning of the collection treatment (S30) of a nicotine component.

—Experimental Conditions—

Type of tobacco raw material; burley type

Heating temperature of tobacco raw material: 120° C.

pH of tobacco raw material after alkali treatment: 9.6

Temperature of collection solvent: 20° C.

Amount of collection solvent: 60 g

Aeration flow during bubbling treatment (aeration treatment and collection treatment): 15 L/min The gas used in the bubbling treatment (aeration treatment) is the atmosphere at about 20° C. and about 60%-RH.

Figure 13:
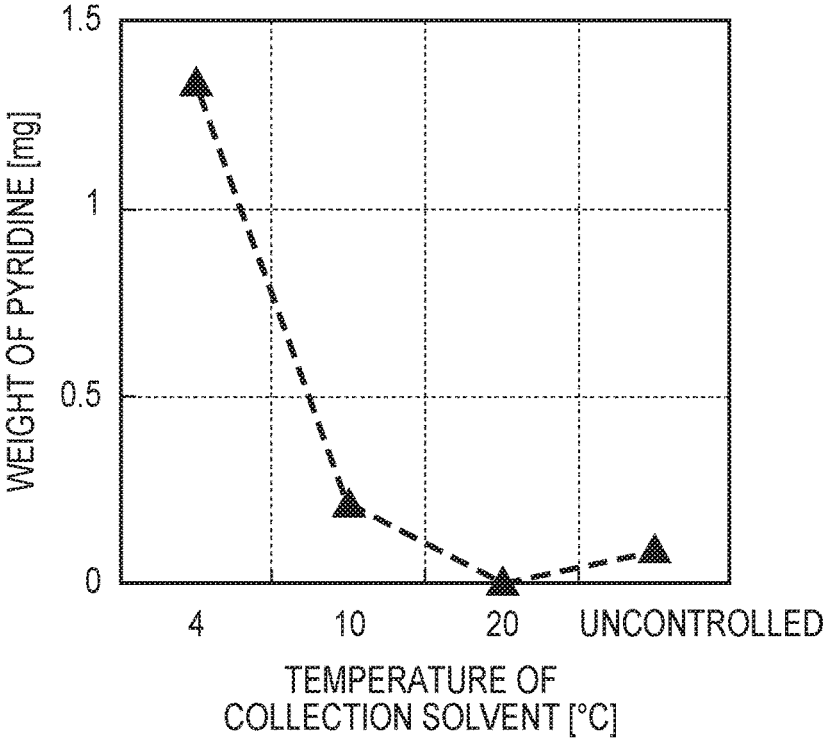
FIG. 13 is a diagram illustrating the fourth experiment.

As shown in FIG. 10, when glycerin, water or ethanol was used as a collection solvent, the absolute values of pH of a collection solution in the stable zone were different, but a significant difference between collection solvents was not shown as the profile of the pH of a collection solution. Similarly, as shown in FIG. 13, when glycerin, water or ethanol was used as a collection solvent, a significant different between the concentrations of nicotine component contained in a collection solution was not shown.

Such experimental results verified that glycerin, water or ethanol could be used as a collection solvent.

(Fourth Experiment)

Figure 12:
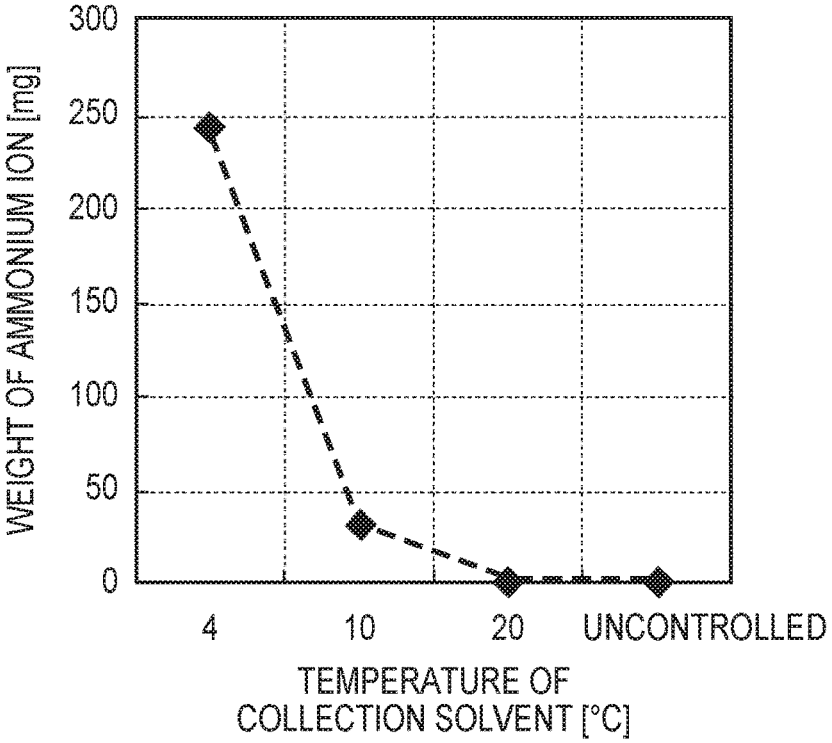
FIG. 12 is a diagram illustrating the fourth experiment.

In the fourth experiment, the weight of ammonium ion and pyridine contained in a collection solution was measured by changing the temperature of a collection solvent under the following conditions. The weight of ammonium ion contained in a collection solution is as shown in FIG. 12. The weight of pyridine contained in a collection solution is as shown in FIG. 13.

—Experimental Conditions—

Type of tobacco raw material; burley type

Heating temperature of tobacco raw material: 120° C.

pH of tobacco raw material after alkali treatment: 9.6

Type of collection solvent: glycerin

Amount of collection solvent: 60 g

First, it was verified that when the temperature of a collection solvent was 10° C. or more, ammonium ion could be efficiently removed as shown in FIG. 12. In the meantime, it was verified that even when the temperature of a collection solvent was not controlled, ammonium ion could be efficiently removed. The vaporization of alkaloid (herein, a nicotine component) from a collection solution is inhibited as long as the temperature of a collection solvent is 40° C. or less. From such viewpoint, by setting the temperature of a collection solvent to 10° C. or more and 40° C. or less, as the vaporization of a nicotine component from a collection solution is inhibited, ammonium ion can be efficiently removed from the collection solution.

Second, it was verified that in the case where the temperature of a collection solvent was 10° C. or more, pyridine could be efficiently removed as shown in FIG. 13. In the meantime, it was verified that even when the temperature of a collection solvent was not controlled, pyridine could be efficiently removed. The vaporization of a nicotine component from a collection solution is inhibited as long as the temperature of a collection solvent is 40° C. or less. From such viewpoint, by setting the temperature of a collection solvent to 10° C. or more and 40° C. or less, as the vaporization of a nicotine component from a collection solution is inhibited, pyridine can be efficiently removed from the collection solution.

The temperature of a capture solvent is the preset temperature of the chiller (a constant-temperature bath) controlling the temperature of a container containing the capture solvent. It should be noted that the temperature of a capture solvent is settled about 60 minutes after the container is set in the chiller and the temperature control starts.

[Measurement Method]

(Method for Measuring pH of Collection Solution)

A collection solution was left to stand in a sealed container until room temperature in a laboratory controlled at room temperature of 22° C. to harmonize the temperature. After harmonization, the lid was opened, and the glass electrode of a pH meter (SevenEasy S20 manufactured by METTLER TOLEDO) was soaked in a collection solution to start the measurement. The pH meter was calibrated in advance using pH meter calibration liquids with pH 4.01, 6.87 and 9.21. A point at which output variations from a sensor become stable within 0.1 mV for 5 seconds was used as the pH of a collection solution.

(Method for Measuring $NH_4^+$ Contained in Collection Solution)

A collection solution was collected in an amount of 50 μL. and diluted by adding 950 μL of a 0.05 N aqueous solution of dilute sulfuric acid, and the diluted solution was analyzed by ion chromatography to quantitate ammonium ion contained in the collection solution.

(Method for Measuring Nicotine Component Contained in Tobacco Raw Material)

The measurement was carried out in a method in accordance with the German Institute for Standardization (DIN) 10373. That is, a tobacco raw material was collected in an amount of 250 mg, and 7.5 mL of a 11% aqueous solution of sodium hydroxide and 10 mL of hexane were added thereto, and shaking extraction was carried out for 60 minutes. After the extraction, the hexane phase, supernatant, was used for a gas chromatograph mass spectrometer (GC/MS) to quantitate the weight of nicotine contained in the tobacco raw material.

(Method for Measuring Amount of Water Contained in Tobacco Raw Material)

A tobacco raw material was collected in an amount of 250 mg, and 10 mL of ethanol was added thereto, and shaking extraction was carried out for 60 minutes. After the extraction, the extract liquid was filtered with a 0.45 μm membrane filter, and used for a gas chromatograph with thermal conductivity detector (GC/TCD) to quantitate the amount of water contained in the tobacco raw material.

The weight of the tobacco raw material in the dry state is calculated by subtracting the above-described amount of water from the gross weight of the tobacco raw material.

(Method for Measuring TSNA Contained in Collection Solution)

A collection solution was collected in an amount of 0.5 mL, and diluted by adding 9.5 mL of a 0.1 M aqueous solution of ammonium acetate, and the diluted solution was analyzed by a high performance liquid chromatograph-mass spectrometer (LC-MS/MS) to quantitate TSNA contained in the collection solution.

(GC Analysis Conditions)

The conditions of GC analysis used to measure the amounts of nicotine component and water contained in a tobacco raw material are as shown in Table given below.

TABLE 1

| | Nicotine | Moisture |
|---|---|---|
| Model number of device (Manufacturer) | Agilent 6890GC&5975MSD (Agilent technologies) | HP 6890 (Hewlett Packard) |
| GC column | DB-1 ms | DB-WAX |

Other Embodiments

The present invention is described by way of the embodiment described above. It should not be understood however that the present invention is limited to the description and figures forming parts of this disclosure. Various alternate embodiments, examples and operation techniques will be apparent to one skilled in the art by this disclosure.

In the embodiment, a case in which the same treatment device 10 (container 11) is used in Step S10 (alkali treatment) and Step S60 (washing treatment) was exemplified. The embodiment is not however limited thereto. For example, a tobacco raw material which has been subjected to the alkali treatment and water addition treatment in advance is placed in the container 11 and Step S20 (heating treatment), Step S30 (capture treatment) and Step S60 (washing treatment) may be carried out.

It is preferred that the volume of a closed space formed by the container 11 used in Step S20 (heating treatment) and Step S60 (washing treatment) not be extremely different from the volume of a tobacco raw material from the viewpoint of reducing the loss of a tobacco raw material by reducing the inner surface of the closed space, which is not described in detail in the embodiment. It is also preferred that the volume of the closed space not be extremely different from the volume of a tobacco raw material from the viewpoint of efficient washing. It is preferred that the shape of the closed space formed by the container 11 not contain an extremely long part and the like from the viewpoint of reducing the loss of a tobacco raw material by reducing the inner surface of the closed space. It is also preferred that the shape of the closed space not contain an extremely long part and the like from the viewpoint of efficient washing. It is preferred that the volume of the closed space be for example 3 times or more and 50 times or less the volume of a tobacco raw material. About the shape of the closed space, it is also preferred that when the lengths of the longest parts in the X direction, the Y direction and the Z direction which are directions intersecting each other at 90 degrees in the closed space are considered as X, Y and Z respectively and two values between X, Y and Z which differ most are used as L and S (S is a value smaller than L), L be 10 times or less higher than S. As long as the volume and shape of the closed space are as described above, the loss of a tobacco raw material can be reduced, and further a tobacco raw material (residue) can be sufficiently washed in Step S60 (washing treatment) using a moderate amount of solvent while moderately stirring the tobacco raw material.

It should be noted that when the inner surface of the closed space is reduced or an extremely long part and the like are not contained in the shape of the closed space, the contact area of a tobacco raw material with the inner surface of the closed space decreases, and a tobacco raw material adhering to the inner surface of the closed space also decreases, thereby reducing the loss of the tobacco raw material.

In the embodiment, the washing treatment (Step S60) is carried out prior to the return treatment (Step S70). The embodiment is not however limited thereto. The washing treatment (Step S60) may be omitted.

The entire contents of Japanese patent application No. 2014-035429 (filed on Feb. 26, 2014) and Japanese patent application No. 2014-035438 (filed on Feb. 26, 2014) are incorporated herein by reference.

INDUSTRIAL APPLICABILITY

According to the present invention, there can be provided a method for producing a tobacco raw material, wherein the method can selectively reduce an impurity component contained in a tobacco raw material by a simple and low-cost process.

REFERENCE SIGNS LIST

10 Treatment device
11 Container
12 Spray
20 Collection device
21 Container
22 Pipe
23 Release section
23A Opening
24 Pipe
50 Tobacco raw material
61 Release component
62 Release component
63 Residual component
100 Flavor inhaler
110 Holder
120 Carbon heat source
130 Flavor source
140 Filter

The invention claimed is:

1. A producing method of a tobacco raw material containing a flavor constituent, comprising:

a step A1 for heating a tobacco raw material, which was treated with alkali, in a closed space at a pressure of +0.1 MPa or less as gauge pressure so as to release a flavor constituent from the tobacco raw material to a gas phase and for taking the flavor constituent released in the gas phase from the tobacco raw material to an outside of the closed space;

a step B1 for allowing a first solvent to capture the flavor constituent by bringing the flavor constituent released in the gas phase in the step A1 into contact with the first solvent which is a liquid substance at a temperature of 10 to 40° C. on the outside of the closed space; and after the step B1, a step C1 for adding the first solvent capturing the flavor constituent in the step B1 to the tobacco raw material from which the flavor constituent is released to the closed space in the step A1 in the closed space.

2. A producing method of a tobacco raw material containing a flavor constituent, comprising:

a step A2 for heating a tobacco raw material, which was treated with alkali, in a closed space at a pressure of +0.1 MPa or less as gauge pressure so as to release a flavor constituent from the tobacco raw material to a gas phase and for taking the flavor constituent released in the gas phase from the tobacco raw material to an outside of the closed space;

a step B2 for allowing a first solvent to capture the flavor constituent by bringing the flavor constituent released in the gas phase in the step A2 into contact with the first solvent which is a liquid substance at a temperature of 10 to 40° C. on the outside of the closed space; and a step C2 for supplying a second solvent to the tobacco raw material in the closed space after the step A2 and for taking a normal component which is released as the liquid phase from the tobacco raw material to the second solvent, together with the second solvent to the outside of the closed space; and after the step B2 and the step C2, the step D2 for adding the first solvent capturing the flavor constituent in the step B2 to the tobacco raw material from which the flavor constituent is released in the closed space in the step A2 in the closed space.

3. The production method according to claim 2, wherein the step C2 is repeated at least twice or more before the step D2.

4. The production method according to claim 3, wherein when n is an integer of 1 or more, a solvent A is used as the second solvent in the n-th step C2, and a solvent B different from the solvent A is used as the second solvent in the n+1-th step C2.

5. The production method according to claim 1, wherein the step A1 comprises a step in which the tobacco source is subjected to a water addition treatment.

6. The production method according to claim 5, wherein in the step A1 or the step A2, an amount of water in the tobacco source before heating the tobacco source becomes 30 wt % or more by the water addition treatment.

7. The production method according to claim 2, wherein the step A2 comprises a step for adding a non-aqueous solvent to the tobacco raw material.

8. The production method according to claim 7, wherein the amount of the non-aqueous solvent is 10 wt % or more with respect to the tobacco raw material.

9. The production method according to claim 7, wherein the step A2 comprises a step for adding the non-aqueous solvent and water to the tobacco raw material.

10. The production method according to claim 1, wherein the step B1 is carried out until any time from when a first condition is satisfied to when a second condition is satisfied, the total amount of saccharides contained in the tobacco raw material is 10.0 wt % or less based on a total weight of the tobacco raw material in a dry state, in a case where a stable zone in which variations in pH of the collection solution are within a predetermined range exists in the time axis elapsing from the beginning of the step A1 after the pH of a collection solution containing the first solvent and the release component decreases by 0.2 or more from a maximum value, the first condition is a condition that a time elapsing from the beginning of the step A1 reaches the start time of the stable zone, the maximum value being the highest value of the pH of the collection solution in the time axis elapsing from the beginning of the step A1, and the second condition is a condition that the remaining amount of nicotine component which is an index of the flavor constituent contained in the tobacco raw material, is decreased to 0.6 wt % or lower based on a total weight of the tobacco raw material in the dry state.

11. The production method according to claim 10, wherein the second condition is a condition that the remaining amount of the nicotine component contained in the tobacco raw material is decreased to 0.4 wt % or lower based on a total weight of the tobacco raw material in the dry state.

12. The production method according to claim 10, wherein the second condition is a condition that the remaining amount of the nicotine component contained in the tobacco raw material is decreased to 0.3 wt % based on a total weight of the tobacco raw material in the dry state.

13. The production method according to claim 10, wherein the tobacco raw material is a burley type tobacco raw material.

14. The production method according to claim 1, wherein the step B1 is carried out at any time from when a first condition is satisfied to when a second condition is satisfied, the first condition is a condition that a remaining amount of nicotine component which is an index of the flavor constituent contained in the tobacco raw material decreases until reaching 1.7 wt % in the case where the weight of the tobacco raw material in the dry state is 100 wt % and the second condition is a condition that the remaining amount of the nicotine component contained in the tobacco raw material is decreased to 0.6 wt % or less based on a total weight of the tobacco raw material in the dry state.

15. The production method according to claim 14, wherein the second condition is a condition that the remaining amount of the nicotine component contained in the tobacco raw material is decreased to 0.4 wt % or less based on a total weight of the tobacco raw material in the dry state.

16. The production method according to claim 14, wherein the second condition is a condition that the remaining amount of the nicotine component contained in the tobacco raw material is decreased to 0.3 wt % based on a total weight of the tobacco raw material in the dry state.

17. The production method according to claim 14, wherein a temperature of the first solvent is 10° C. or more and 40° C. or less.

18. The production method according to claim 2, wherein the step A2 comprises a step in which the tobacco source is subjected to a water addition treatment.

19. The production method according to claim 2, wherein the step B2 is carried out until any time from when a first condition is satisfied to when a second condition is satisfied, the total amount of saccharides contained in the tobacco raw material is 10.0 wt % or less based on a total weight of the tobacco raw material in a dry state, in a case where a stable zone in which variations in pH of the collection solution are within a predetermined range exists in the time axis elapsing from the beginning of the step A2 after the pH of a collection solution containing the first solvent and the release component decreases by 0.2 or more from a maximum value, the first condition is a condition that a time elapsing from the beginning of the step A2 reaches the start time of the stable zone, the maximum value being the highest value of the pH of the collection solution in the time axis elapsing from the beginning of the step A2, and the second condition is a condition that the remaining amount of nicotine component, which is an index of the flavor constituent contained in the tobacco raw material, is decreased to 0.6 wt % or lower based on a total weight of the tobacco raw material in the dry state.

20. The production method according to claim 2, wherein the step B2 is carried out at any time from when a first condition is satisfied to when a second condition is satisfied, the first condition is a condition that a remaining amount of nicotine component which is an index of the flavor constituent contained in the tobacco raw material decreases until reaching 1.7 wt % in the case where the weight of the tobacco raw material in the dry state is 100 wt % and the second condition is a condition that the remaining amount of the nicotine component contained in the tobacco raw material is decreased to 0.6 wt % or less based on a total weight of the tobacco raw material in the dry state.

* * * * *